US009691308B2

(12) United States Patent
Meyer et al.

(10) Patent No.: US 9,691,308 B2
(45) Date of Patent: Jun. 27, 2017

(54) LIGHTED MOUNTING APPARATUS

(71) Applicant: Tagnetics, Inc., Troy, OH (US)

(72) Inventors: Matthew J. Meyer, Versailles, OH (US); Ronald E. Earley, New Carlisle, OH (US)

(73) Assignee: Tagnetics, Inc., Troy, OH (US)

( * ) Notice: Subject to any disclaimer, the term of this patent is extended or adjusted under 35 U.S.C. 154(b) by 238 days.

(21) Appl. No.: 14/701,592

(22) Filed: May 1, 2015

(65) Prior Publication Data

US 2015/0235577 A1 Aug. 20, 2015

Related U.S. Application Data

(60) Division of application No. 14/262,927, filed on Apr. 28, 2014, now Pat. No. 9,022,637, which is a continuation-in-part of application No. 14/217,902, filed on Mar. 18, 2014, now abandoned.

(60) Provisional application No. 61/817,447, filed on Apr. 30, 2013, provisional application No. 61/833,179, filed on Jun. 10, 2013.

(51) Int. Cl.

| | |
|---|---|
| ***F21V 7/04*** | (2006.01) |
| ***G09F 13/18*** | (2006.01) |
| ***G09F 3/20*** | (2006.01) |
| ***A47F 5/00*** | (2006.01) |
| ***A47F 3/00*** | (2006.01) |
| ***G09F 23/06*** | (2006.01) |
| *G09F 13/22* | (2006.01) |
| *G09F 13/04* | (2006.01) |

(52) U.S. Cl.

CPC ..... *G09F 13/18* (2013.01); *A47F 3/001* (2013.01); *A47F 5/0068* (2013.01); *G09F 3/208* (2013.01); *G09F 23/06* (2013.01); *G09F 2013/049* (2013.01); *G09F 2013/0445* (2013.01); *G09F 2013/1831* (2013.01); *G09F 2013/222* (2013.01)

(58) Field of Classification Search

CPC ..... A47F 3/001; A47F 5/0068; G09F 3/208; G09F 13/00; G09F 13/04; G09F 13/18; G09F 23/06; G09F 2013/1831; G09F 2013/222

USPC ..... 362/249.02, 612, 621, 812; 40/299.01, 40/541, 546, 642.02

See application file for complete search history.

(56) References Cited

U.S. PATENT DOCUMENTS

| | | | |
|---|---|---|---|
| 4,447,885 | A | 5/1984 | Biss |
| 5,537,126 | A | 7/1996 | Kayser et al. |
| 5,736,967 | A | 4/1998 | Kayser et al. |
| 5,837,952 | A | 11/1998 | Oshiro et al. |
| 5,986,221 | A | 11/1999 | Stanley |
| 6,249,263 | B1 | 6/2001 | Kayser et al. |
| 6,266,052 | B1 | 7/2001 | Kayser et al. |

(Continued)

FOREIGN PATENT DOCUMENTS

| | | |
|---|---|---|
| WO | 2005/071623 A1 | 8/2005 |
| WO | 2012/072397 A1 | 6/2012 |

OTHER PUBLICATIONS

International Searching Authority, International Search Report PCT/US14//41704 mailed Dec. 16, 2014, 1pg.

(Continued)

*Primary Examiner* — Jason Moon Han

(74) *Attorney, Agent, or Firm* — Duane Morris LLP

(57) ABSTRACT

A lighted mounting apparatus for a promotional glass holder including a channel which is lined on the bottom by a LED strip, a pair of extrusions to receive and hold a promotional glass, and a low voltage power supply.

20 Claims, 7 Drawing Sheets

(56) References Cited

U.S. PATENT DOCUMENTS

| | | | |
|---|---|---|---|
| 6,271,807 | B1 | 8/2001 | Kayser et al. |
| 6,844,821 | B2 | 1/2005 | Swartzel et al. |
| 6,924,781 | B1 | 8/2005 | Gelbman |
| 7,152,040 | B1 | 12/2006 | Hawthorne et al. |
| 7,989,714 | B2 | 8/2011 | Kresina |
| 8,232,683 | B2 | 7/2012 | Garb |
| 8,323,216 | B2 | 12/2012 | Fabian |
| 2002/0017045 | A1 | 2/2002 | Weiss et al. |
| 2002/0109593 | A1 | 8/2002 | Swartzel et al. |
| 2002/0167500 | A1 | 11/2002 | Gelbman |
| 2003/0031032 | A1 | 2/2003 | Wu et al. |
| 2003/0102851 | A1 | 6/2003 | Stanescu et al. |
| 2004/0034581 | A1 | 2/2004 | Hill et al. |
| 2005/0027603 | A1 | 2/2005 | Green |
| 2005/0171854 | A1 | 8/2005 | Lyon |
| 2006/0071774 | A1 | 4/2006 | Brown et al. |
| 2008/0001590 | A1 | 1/2008 | Yang et al. |
| 2008/0052201 | A1 | 2/2008 | Bodin et al. |
| 2008/0183599 | A1 | 7/2008 | Hill et al. |
| 2009/0213629 | A1 | 8/2009 | Liu et al. |
| 2009/0229154 | A1 | 9/2009 | Sadon |
| 2011/0241843 | A1 | 10/2011 | Marsanne et al. |
| 2011/0259960 | A1 | 10/2011 | Baarman et al. |
| 2013/0027986 | A1 | 1/2013 | Atrash et al. |

OTHER PUBLICATIONS

International Searching Authority, International Search Report PCT/US14/35603 mailed Aug. 28, 2014, 1pg.

International Searching Authority, International Search Report PCT/US14/30986 mailed Aug. 27, 2014, 1pg.

LIGHTED MOUNTING APPARATUS

CROSS-REFERENCE TO RELATED APPLICATION

This application is a divisional of U.S. patent application Ser. No. 14/262,927, now U.S. Pat. No. 9,022,637, filed Apr. 28, 2014, which is a Continuation-in-Part of U.S. patent application Ser. No. 14/217,902 filed Mar. 18, 2014, which in turn claims the priority of U.S. Provisional Patent Application Ser. No. 61/817,447 filed Apr. 30, 2013 and U.S. Provisional Patent Application Ser. No. 61/833,179 filed Jun. 10, 2013. The entirety of these applications are incorporated herein by reference.

FIELD OF THE INVENTION

The present disclosure generally relates to a lighted mounting apparatus. More specifically, the present disclosure generally relates to a lighted mounting apparatus for mounting promotional signs on retail store shelving.

BACKGROUND

Many consumers make purchasing decisions about a specific product at the shelf of a retail store. In an effort to influence this decision process, retailers and packaged goods manufacturers use various advertising and promotional methods to highlight a specific product at the point of display. Retailers and packaged goods manufacturers are constantly searching for simple, inexpensive, and effective ways to promote their products.

Many promotional displays designed for retail shelves use electricity. However, these displays generally receive electrical power via batteries or standard wall outlets. Batteries are problematic for use in this application because of their limited lifespan, limited power output, and the high personnel and material costs to replace them. Standard wall outlets allow for unlimited lifespan but require power conversion for most applications. Additionally, standard wall outlets are expensive to install, may be subject to national and local electrical codes and carry additional safety concerns such as the need to be encased in conduit.

SUMMARY OF THE DISCLOSURE

The present disclosure is directed to a promotional display which obviates many of the deficiencies cited above. The present disclosure is generally directed to a lighted mounting apparatus including a three-sided promotional glass holder, connected to a mounting strip, that includes a channel which is lined on the bottom by a LED strip and includes a pair of extrusions extending within the channel. Promotional glass can be inserted into the channel and held in place by the pair of extrusions. A low voltage power may be used to power the LED strip. Suitable low voltage power may include USB-1, USB-2, or USB-3 voltage, frequency, and amperage.

BRIEF DESCRIPTION OF THE DRAWINGS

The foregoing and other advantages of the present disclosure will become apparent upon reading the following detailed description and upon reference to the drawings.

Figure 1:
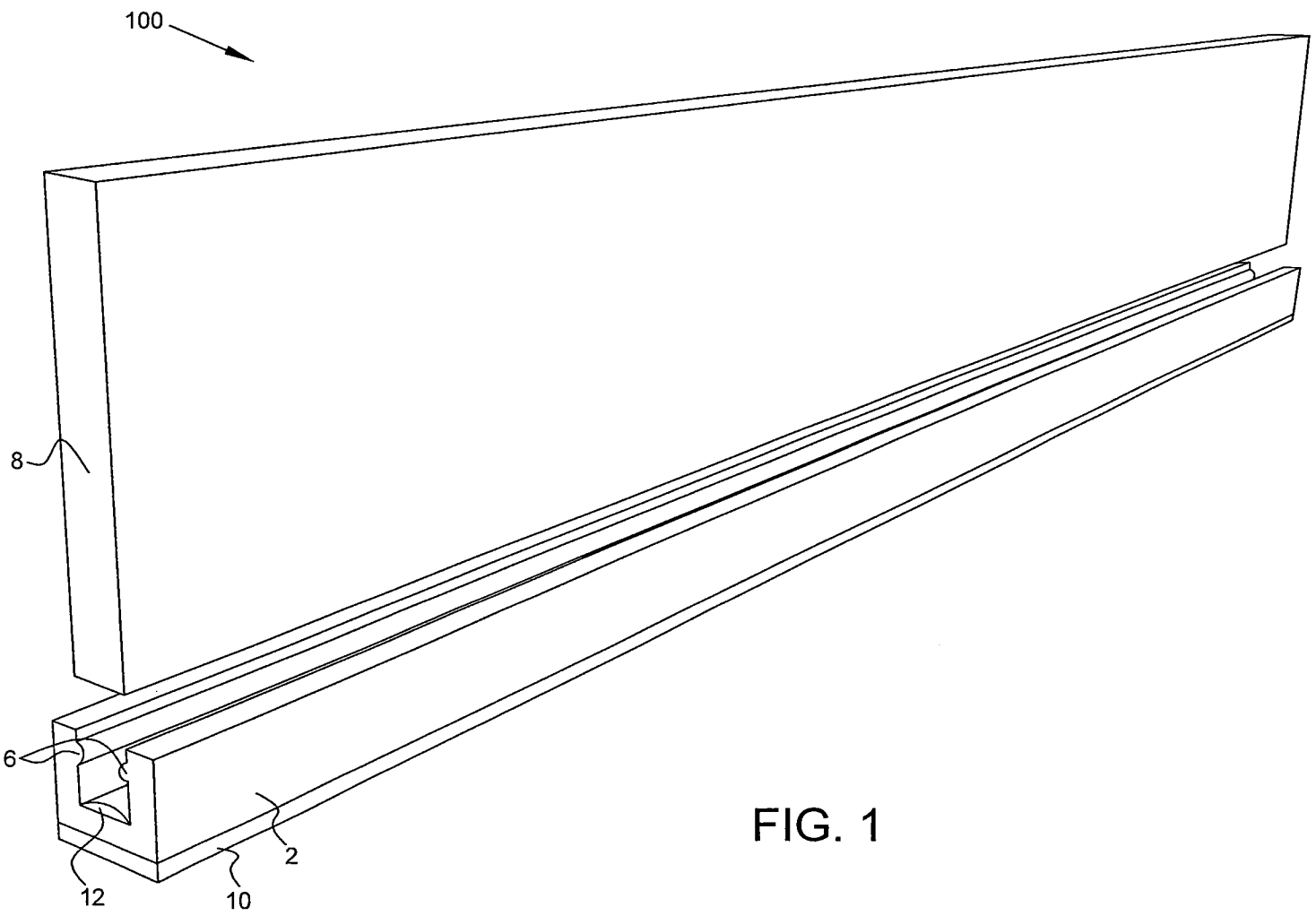
FIG. 1 is an angled side view of a lighted mounting apparatus in accordance with some embodiments.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

The present disclosure is directed to a promotional glass display system comprising a lighted mounting apparatus which requires neither batteries nor standard outlet power for operation. Instead, the lighted mounting apparatus is connected a low-voltage power supply. In some embodiments, the lighted mounting apparatus is inductively coupled to a power stringer to receive a low voltage power supply. In some embodiments, the power supply system additionally supplies power to a plurality of electronic shelf labels or similar retail devices.

In a first embodiment, illustrated in FIG. 1, a lighted mounting apparatus 100 comprises a three-sided promotional glass holder 2 which defines a channel 4 for holding a promotional glass panel 8. A pair of extrusions 6 on either side of channel 4 assist in holding a promotional glass panel 8, also referred to as a display panel, in place. In one embodiment a mounting strip 10 may be fastened to the glass holder to help secure the glass holder to a retail shelf 20 (see FIG. 3). At the bottom of channel 4 is located a strip of light emitting diodes (herein "LED strip 12") for illuminating promotional glass panel 8.

Figure 2:
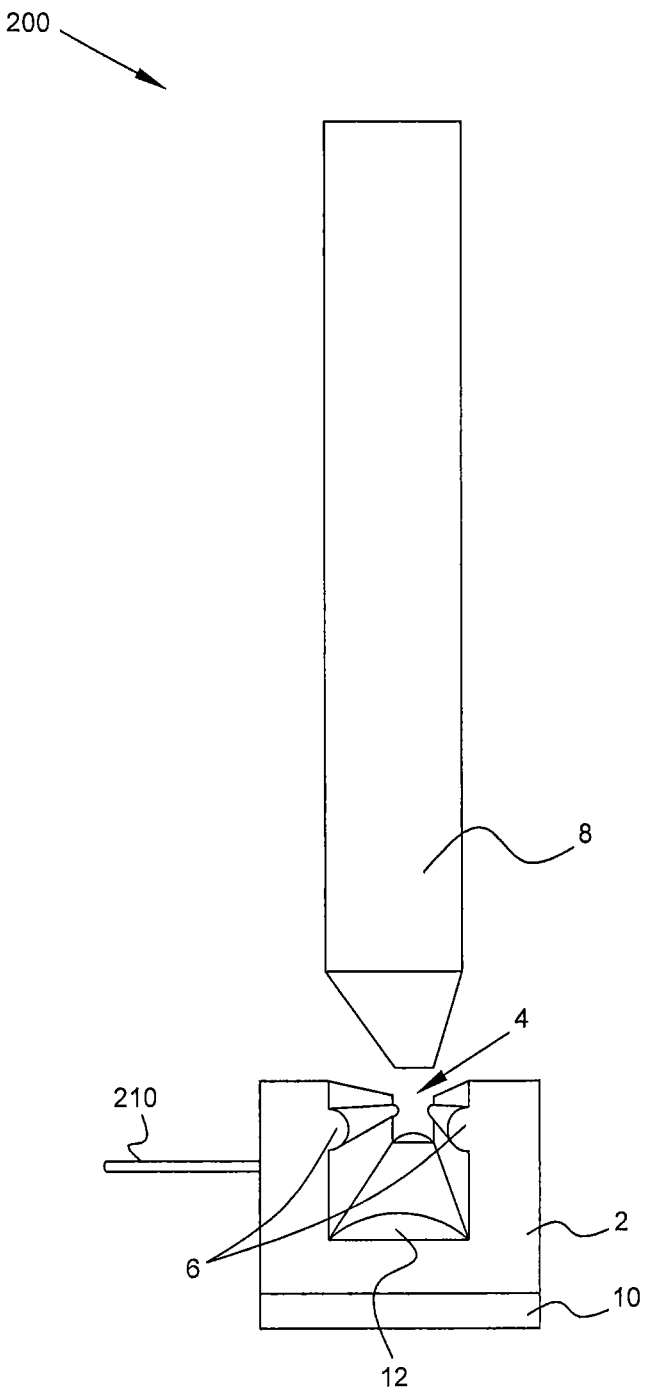
FIG. 2 is a side profile view of a lighted mounting apparatus in accordance with some embodiments.

Promotional glass holder 2 can be mounted to a retail shelf 20 in a number of ways. Holder 2 can be mounted using standard hardware (i.e.—nuts, bolts, and screws), adhesive, or using a magnetic strip that will magnetically connect to a metal retail shelf 20. In some embodiments, such as that shown in FIG. 1, a mounting strip 10 is mounted to the retail shelf 20 via the aforementioned means and then holder 2 is connected on top of mounting strip 10 to form a connection with a retail shelf 20. In other embodiments, visible in FIG. 2, a mounting bracket 210 is connected to the back of the holder 2 and used to secure holder 2 to retail shelf 20. In still other embodiments, holder 2 is mounted directly to the retail shelf 20 without the need to use a mounting strip 10. In some embodiments holder 2 is connected to a product system, such as a 'pusher' system known in the art to push products forward on the shelf as they are removed by customers—and mounted to retail shelf 20 as an integral part of this larger product system.

Extrusions 6 are spaced apart and dimensionally provided to cooperatively impart a frictional force to promotional glass panel 8. Extrusions 6 may be constructed of the same material as holder 2 or may be specially coated, covered, or constructed from an alternate material to aid in gripping and holding promotional glass panel 8. Similarly, extrusions 6 may have an outer surface with ridges or small protrusions to aid in gripping an holding promotional glass panel 8. In one embodiment, extrusions are constructed from a material designed to absorb the shock of items imparting a force to the promotional glass panel 8. In some embodiments, extrusions are hemispherically shaped.

Figure 3:
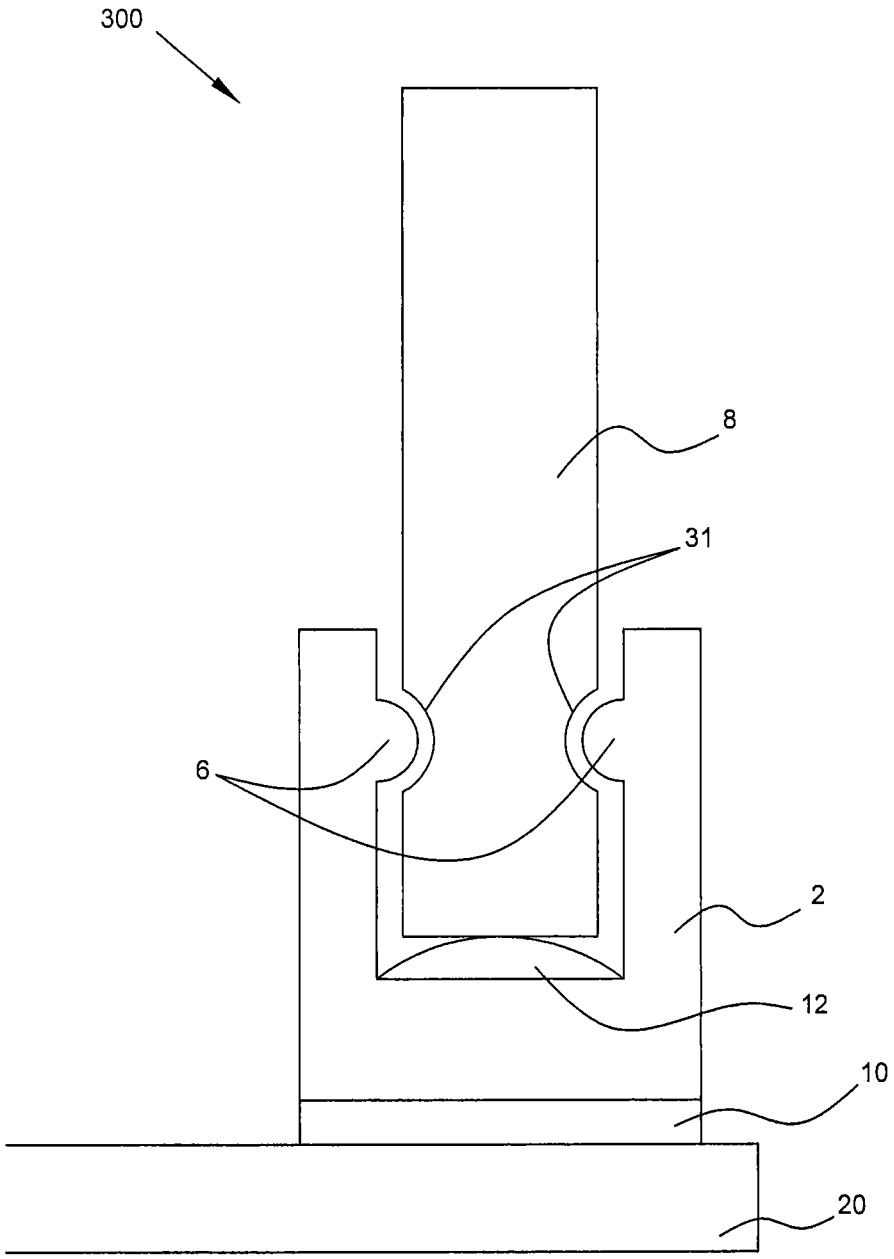
FIG. 3 is a side profile view of a lighted mounting apparatus with promotional glass disposed within the apparatus, in accordance with some embodiments.

In some embodiments, such as the lighted mounting apparatus 300 illustrated in FIG. 3, promotional glass panel 8 is configured with a pair of grooves 31, one on each side of the promotional glass panel 8, that cooperates with the extrusions 6 to more securely position the promotional glass panel 8 in the holder 2.

A LED strip 12 may be positioned in the bottom of channel 4 to provide illumination to promotional glass panel 8. Many configurations of LED type, spacing, and characteristics are possible in the present disclosure. In some embodiments, the LED strip 12 is composed of a plurality of evenly-spaced RGB (red-green-blue) LEDs.

Promotional glass panel 8 is typically constructed from glass, translucent plastic, or similar material and etched or printed with a brand or product name or any other suitable design including logos, instructions, promotional information or the like. In one embodiment, the promotional information may include where to find a related product. For example, a promotional display for nail polish remover may include a promotional arrow pointing to where the cotton balls are on display adjacent to the nail polish. In another embodiment, the promotional display can indicate what products can be combined for an additional discount. For example, for a promotion where the purchase on any two flavors of soup include two additional flavors for free, the promotional glass can indicate, in words, or color, or design, all of the soups that are subject to the promotional offer.

Promotional glass panel 8 may be illuminated by the light from LED strip 12. In some embodiments, promotional glass may be constructed of a translucent material which allows the light from the LED to transmit through the glass and highlight any words or designed etched in or printed on the translucent material. Suitable translucent materials may be glass, plastics, acrylics or other material of sufficient durability. In another embodiment, the promotional glass may be plain, and the LEDs are configured to impart a design or words on the glass.

Figure 4:
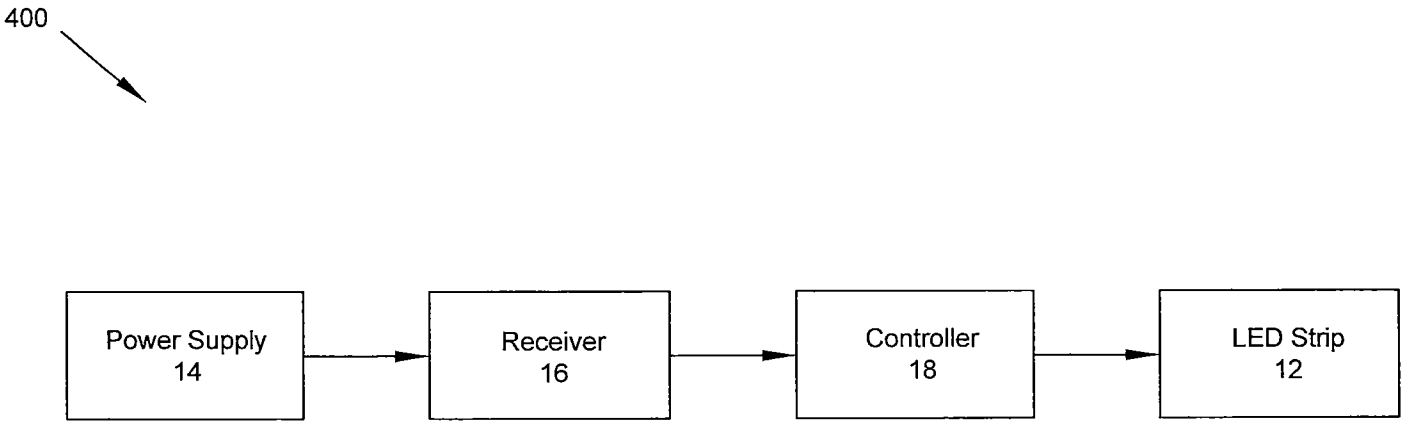
FIG. 4 is a schematic diagram of the power system of a lighted mounting apparatus in accordance with some embodiments.

FIG. 4 is a simplified schematic diagram of one embodiment of a promotional glass holder power supply system 400. Power supply 14 supplies power to LED strip 12 via a receiver 16 and controller 18. In some embodiments, power supply 14 is a low-voltage power supply. In some embodiments power supply 14 is a standard Universal Serial Bus (USB) power supply. In some embodiments, power supply 14 supplies electric power between 10 and 12 volts and 100 to 200 mA.

Receiver 16 may provide a means for coupling power supply 14 and controller 18. In some embodiments, the power supply 14 is received by receiver 16 which is a standard micro-b USB connector. In some embodiments, multiple receivers 16 are used to receive sufficient voltage for electrically powering LED strip 12.

Controller 18 may control the flow of electric power between receiver 16 and LED strip 12. Controller 18 ensures electric power supplied to LED strip 12 is the proper voltage and frequency. In some embodiments, controller 18 can be used to create various effects with the LED lighting, such as fade in/out, blinking, low or high illumination, and color changes.

Figure 7:
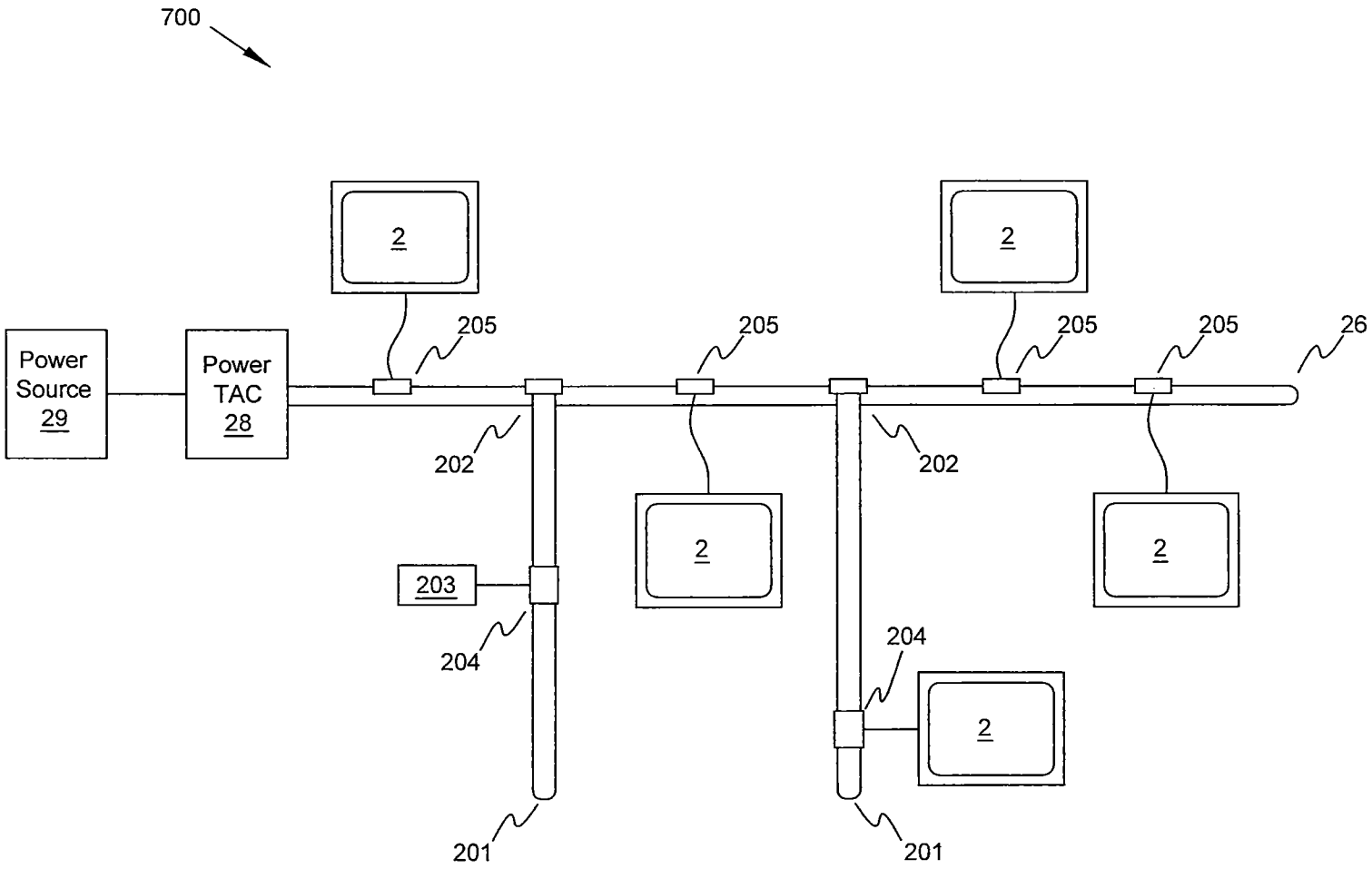
FIG. 7 is a schematic diagram of a power distribution system in accordance with some embodiments.

FIG. 7 is a schematic diagram of another embodiment of a promotional glass holder power distribution system 700 for at least one promotional glass holder 2 in accordance with some embodiments. In some embodiments, power distribution system 700 distributes power to a plurality of promotional glass holders 2. In some embodiments, power distribution system 700 additionally distributes power to a plurality of electronic shelf labels (ESLs) 203.

In some embodiments power source 29 is a standard wall outlet well known in the art. Electrical power flows through a Power TAC 28 to a power stringer 26. In some embodiments the power stringer 26 is called the primary distribution loop. In some embodiments power stringer 26 distributes power at between 45 and 50 VAC, 50 KHz, and 1 ampere. A frequency of 50 KHz was selected in part to comply with applicable regulatory requirements.

Power stringer 26 conveys power from the Power TAC 28 to at least one promotional glass holder 2. Each promotional glass holder 2 is connected to the power stringer 26 via a power converter 205. In some embodiments, power stringer 26 additionally conveys power to at least one secondary distribution loop 201. A secondary distribution loop 201 may also be referred to as a riser. Each secondary distribution loop 201 is connected to power stringer 26 via a primary-secondary connection 202. In some embodiments, the primary-secondary connection 202 is a step-down transformer which maintains the secondary distribution loop 201 at a lower voltage, frequency, and/or amperage than the power stringer 26. In other embodiments, the primary-secondary connection 202 maintains the secondary distribution loop 201 at the same voltage, frequency, and amperage as power stringer 26.

In the embodiments, such as that pictured in FIG. 7, a plurality of promotional glass holders 2 are connected to a single power source 29 using a single power stringer 26 and a plurality of power converters 205. In some embodiments, a plurality of promotional glass holders 2 may receive electrical power by a plurality of power sources 29 or a plurality of power stringers 26. In some embodiments, the power source 29 is connected to a power stinger 26 via inductive coupling. In some embodiments, at least one promotional glass holder 2 is powered via the secondary distribution loop using a power coupler 204.

In some non-limiting embodiments, power converter 205 and power coupler 204 are those described in U.S. patent application Ser. No. 14/217,902.

In some embodiments, Power TAC 28 is a Tag Area Controller as used in a system of electronic shelf labels such as that disclosed in U.S. Pat. Nos. 5,537,126; 5,736,967; 6,249,263; 6,271,807; and 6,844,821. In other embodiments, Power TAC 28 may be removed allowing each power converter to connect to the power source 29. In some embodiments, the Power TAC 28 is an electrical power strip. From power converter 205 power is provided to a promotional glass holder 2 In some embodiments, the control for a Power TAC 28 is provided by a general purpose computer processor. In some embodiments, the electronic shelf labels are connected to the secondary distribution loop via a power coupler 204.

In some embodiments, holder 2 is mounted inverted from the bottom of a retail shelf 20. In this embodiment, holder 2 is mounted in the same manner as previously described, but the promotional glass panel 8 hangs from holder 2 and is positioned above the merchandise on retail shelf 20.

Figure 5:
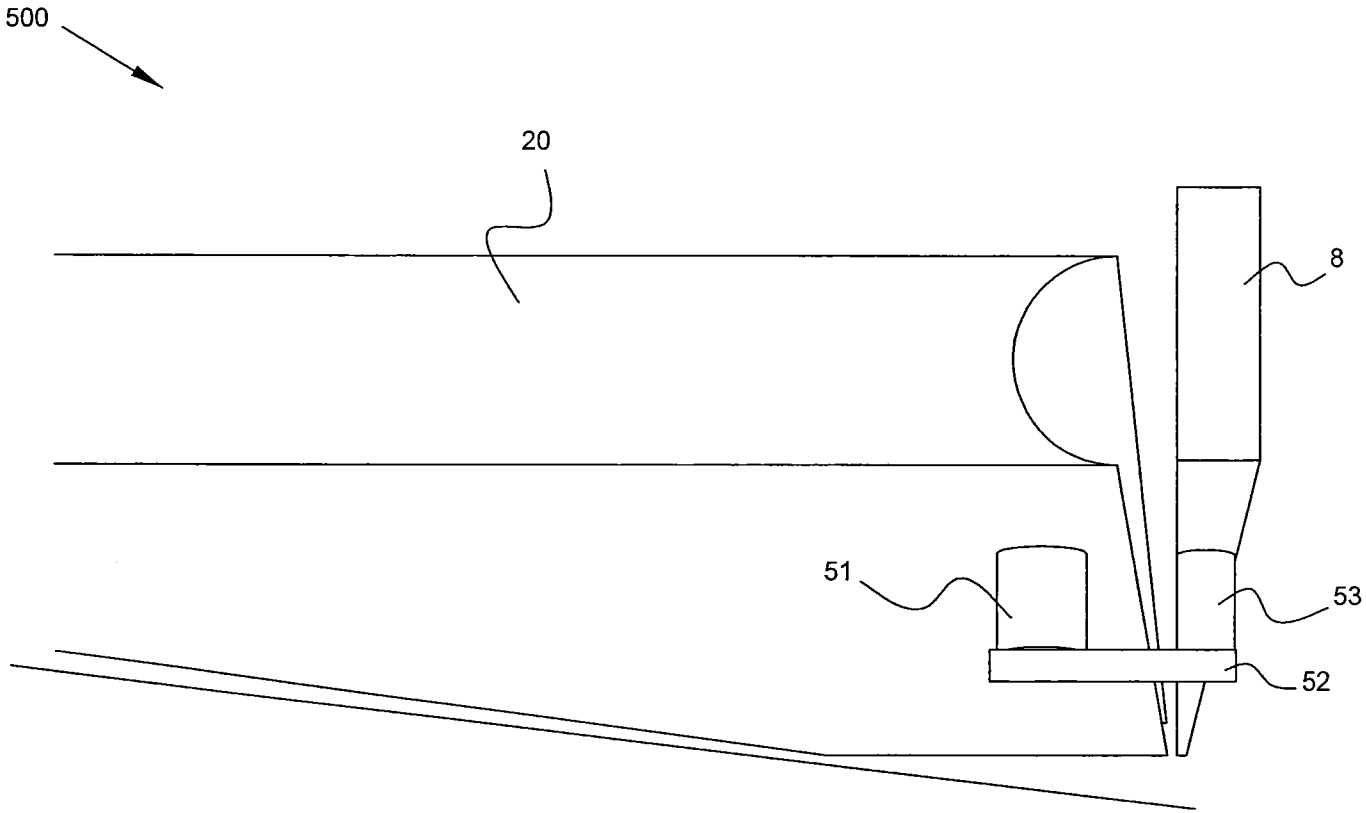
FIG. 5 is an angled side view of a lighted mounting apparatus in accordance with some embodiments.
Figure 6:
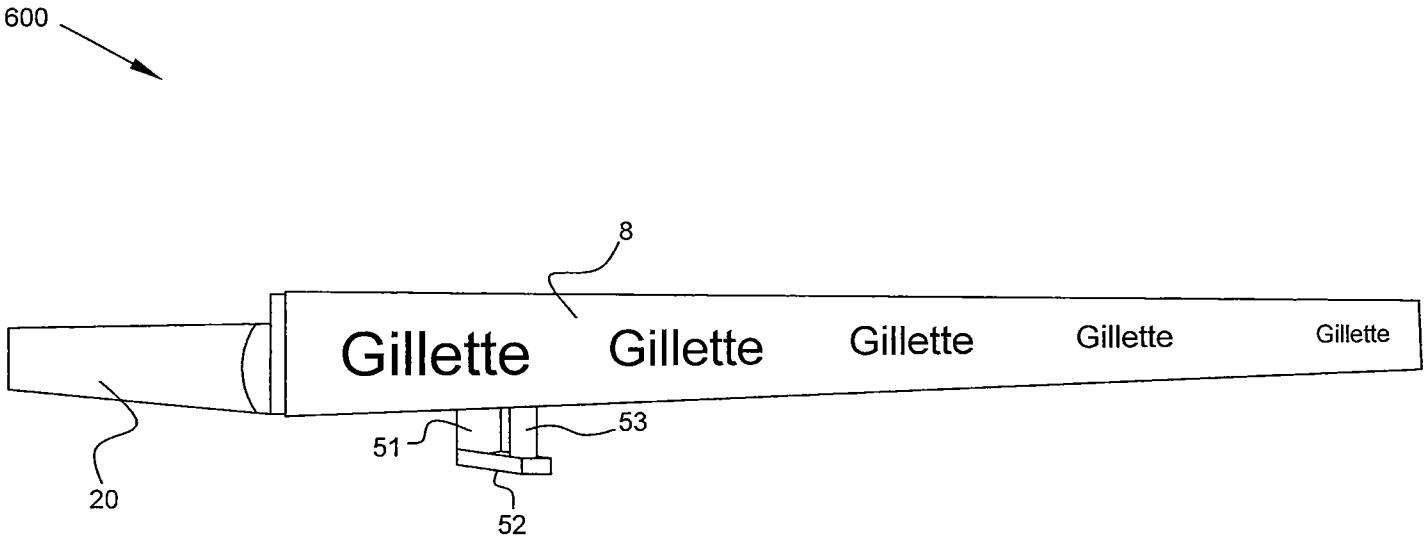
FIG. 6 is an angled side view of a lighted mounting apparatus in accordance with some embodiments.

In another embodiment, such as lighted mounting apparatus 500 illustrated in FIGS. 5 and 6, promotional glass panel 8 may be undermounted in front of retail shelf 20.

Undermounting is accomplished by connecting the lighted mounting apparatus 500 to the underside of a retail shelf as opposed to the top side. In some embodiments, a first spacer 51 and second spacer 53, are connected to an extender 52 to provide a means for mounting either promotional glass panel 8 or holder 2 in front of retail shelf 20.

In still further embodiments, LED strips 12 may be used to provide general lighting to a retail shelf 20, In another embodiment, LED strips 12 may be used to illuminate various promotional signs, framed messages, or other promotional displays. Providing a low-voltage power supply 14 to LEDs at a retail shelf 20 has numerous additional applications, such as auxiliary promotional devices include coupon providers, audio devices, motions sensors and the like. In one embodiment, the power supply provides power to a motion detector which cause the promotional display to illuminate only upon activation by the motion sensor to provide a more "eye-catching" display to a potential purchaser in the vicinity of the display.

In still further embodiments, promotional glass holder 2 may be used in coordination with out-of-stock sensors or inventory sensors on the shelf. In some embodiments, inventory sensors notify controller 18 when a retail item is out-of-stock and controller 18 changes the light color of LED strip 12 to indicate to retail store personnel that the item is out-of-stock. In some embodiments, an inventory sensor notifies controller 18 when inventory of a retail item reaches a predetermined threshold and controller 18 changes the light color of LED strip 12 to indicate to retail store personnel that the item has low inventory.

In still further embodiments, controller 18 includes circuitry for communicating via a low-voltage power supply such as that disclosed in U.S. Pat. Nos. 5,537,126; 5,736,967; 6,249,263; 6,271,807; and 6,844,821. Controller 18 may communicate with a central control processor or with a second controller on a second promotional glass holder. In this embodiments, a plurality of promotional glass holders, via communication means, may operate in tandem or in a coordinated manner. For example, a pair of promotional glass holders located adjacent to each other on a retail shelf could operate with a flashing green light, coordinated to flash at the same time. Further, a plurality of promotional glass holders and a plurality of inventory sensors, communicating with each other or with a central control processor, could coordinate promotional efforts to gain the attention of a consumer. For example, if a consumer removes a can of soup from one area of a retail shelf, and soup in another area of the retail shelf is part of a special promotion or sale related to the removed can of soup, then the LED strip 12 of a second promotional glass holder may begin flashing or otherwise indicating the special promotion or sale to the consumer.

The present disclosure thus provides a lighted mounting apparatus for use in a retail display which is integrated with a low-voltage power distribution system which supplies power to a plurality of electronic shelf labels. The present disclosure includes many advantages over the existing art. Most notably, the low voltage power supply 14 is less expensive to install than a standard 120V electrical system. Due to its low voltage, power supply 14 also has significantly fewer safety concerns and code requirements. The present disclosure is also eliminates the need to change batteries—a time- and labor-intensive process that adds to a retailer's expense of maintaining a promotional system. The present disclosure is further designed to be integrated within a larger low-power distribution system, such as that used to supply power to a plurality of electronic shelf labels in a retail store.

It may be emphasized that the above-described embodiments, particularly any "preferred" embodiments, are merely possible examples of implementations, merely set forth for a clear understanding of the principles of the disclosure. Many variations and modifications may be made to the above-described embodiments of the disclosure without departing substantially from the spirit and principles of the disclosure. All such modifications and variations are intended to be included herein within the scope of this.

While this specification contains many specifics, these should not be construed as limitations on the scope of any disclosures, but rather as descriptions of features that may be specific to particular embodiment. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

What is claimed is:

1. A promotional glass display, comprising:

a bottom panel defining a first plane;

a pair of side panels, each side panel connected to the bottom panel at opposing ends of the bottom panel, and each side panel normal to the first plane, such that the pair of side panels and the bottom panel together form a channel;

a light strip mounted within the channel;

a pair of hemispherical shaped extrusions, each extrusion connected to a side panel on opposing sides of the channel and extending into the channel in a direction which is parallel to the first plane;

a mounting plate for mounting the promotional glass display to a retail shelf, connected beneath the bottom panel;

a display panel removeably disposed within the channel by a pair of grooves configured to engage the pair of extrusions when the display panel is disposed within the channel; and an inductive power coupler for connecting the light strip to a power supply.

2. The promotional glass display of claim 1 further comprising a controller connected between the light strip and the power supply.

3. The promotional glass display of claim 2 wherein the controller comprises an inventory control system.

4. The promotional glass display of claim 3 wherein the controller is configured to cause the light strip to flash when a retail product associated with the promotional glass display is at or below a low inventory threshold.

5. The promotional glass display of claim 3 wherein the controller is configured to cause the light strip to flash when a retail product associated with the promotional glass display is out of stock.

6. The promotional glass display of claim 3 further comprising a motion detector in communication with the controller, wherein the controller is configured to cause the light strip to flash when the motion detector detects motion.

7. The promotional glass display of claim 1 where in the display panel is constructed from translucent material.

8. The promotional glass display of claim 7 wherein the controller causes the light strip to at least one of flash, fade in and out, or change color.

9. The promotional glass display of claim 8 wherein the extrusions are coated with a material to aid in gripping.

10. A promotional glass display system comprising:

a promotional glass holder comprising:

a channel defined by at least three sides;

a light strip disposed within the channel containing a plurality of light emitting diodes; and a pair of extrusions disposed within the channel;

a promotional glass panel comprising a translucent material having an etched design and a pair of grooves, the promotional glass panel selectably disposed within the channel such that the pair of grooves are engaged with the pair of extrusions; and an inductive coupling connector for connecting the light strip with a controller and a power supply.

11. The promotional glass display system of claim 10 wherein the pair of extrusions each have a ridged surface to aid engagement with the grooves of the promotional glass panel.

12. The promotional glass display system of claim 10 wherein the promotional glass holder is undermounted to a retail shelf.

13. The promotional glass display system of claim 10 wherein the controller comprises an inventory control system.

14. The promotional glass display system of claim 13 wherein the promotional glass display is associated at the controller with a retail product and wherein the light strip illuminates the promotional glass panel with a first color when the retail product is in stock.

15. The promotional glass display system of claim 14 wherein the light strip illuminates the promotional glass panel with a second color when the retail product is out of stock.

16. The promotional glass display system of claim 15 wherein the light strip illuminates the promotional glass panel with a third color when the retail product has an inventory at or below a low inventory threshold.

17. The promotional glass display system of claim 16 further comprising a motion detector in communication with the controller, wherein the controller is configured to cause the light strip to flash when the motion detector detects motion.

18. A retail product promotional system, comprising:

a first promotional glass display and a second promotional glass display, each promotional glass display comprising:

a promotional glass holder comprising a channel defined by at least three sides having a light strip and a pair of extrusions disposed within the channel, and a mounting strip configured for mounting the promotional glass holder to a retail shelf;

a promotional glass panel having a pair of grooves configured to engage the pair of extrusions;

a first retail product inventory detector associated with the first promotional glass display and a second retail product inventory detector associated with the second promotional glass display; and a controller connected to the first promotional glass display, the second promotional glass display, the first retail product inventory detector, and the second retail product inventory detector;

wherein the controller is configured to receive a signal from the first retail product inventory detector indicating a retail product has been removed from the shelf and to cause the light strip of the second promotional glass display to flash to indicate to a customer a related product promotion.

19. The retail product promotional system of claim 18 wherein the light strip of the second promotional glass display is inductively coupled to the controller.

20. The retail product promotional system of claim 19 wherein the controller is further configured to cause the second promotional glass display to flash for a predetermined time.

* * * * *